US005670739A

United States Patent [19]

Patterson et al.

[11] Patent Number: 5,670,739

[45] Date of Patent: Sep. 23, 1997

[54] TWO PHASE EMULSION USEFUL IN EXPLOSIVE COMPOSITIONS

[75] Inventors: William P. Patterson, Mentone; David N. Self, Oakman, both of Ala.

[73] Assignee: Nelson Brothers, Inc., Birmingham, Ala.

[21] Appl. No.: 604,834

[22] Filed: Feb. 22, 1996

[51] Int. Cl.[6] ..... C06B 45/00

[52] U.S. Cl. ..... 149/2; 149/6; 149/7; 149/46; 149/109.6

[58] Field of Search ..... 149/2, 6, 7, 46, 149/109.6

[56] References Cited

U.S. PATENT DOCUMENTS

| | | | |
|---|---|---|---|
| 4,008,108 | 2/1977 | Chrisp | 149/2 |
| 4,181,546 | 1/1980 | Clay | 149/21 |
| 4,602,970 | 7/1986 | Stigsson . | |
| 4,722,757 | 2/1988 | Cooper et al. | 149/2 |
| 4,737,207 | 4/1988 | Ehrnström et al. . | |
| 4,775,431 | 10/1988 | Mullay . | |
| 4,830,687 | 5/1989 | Mullay et al. . | |
| 4,836,870 | 6/1989 | Cunningham et al. . | |
| 4,911,770 | 3/1990 | Oliver et al. | 149/2 |
| 4,919,179 | 4/1990 | Chattopadhyay | 149/2 |
| 4,980,000 | 12/1990 | Sohara | 149/2 |
| 4,992,119 | 2/1991 | Carlsen et al. . | |
| 4,995,925 | 2/1991 | Engsbräten . | |
| 5,034,071 | 7/1991 | VanOmmeren | 149/7 |
| 5,120,375 | 6/1992 | Mullay et al. | 149/7 |
| 5,271,779 | 12/1993 | Engsbräten . | |
| 5,397,399 | 3/1995 | Lownds . | |
| 5,500,062 | 3/1996 | Chattopadhyay | 149/46 |

*Primary Examiner*—Edward A. Miller

[57] ABSTRACT

Provided is a two phase emulsion which is useful in preparing explosive compositions. The two phase emulsion is comprised of a blend of two water in oil emulsions. The two phase emulsion is comprised of a continuous oil matrix in which ammonium nitrate micelles and water micelles both exist separately in stable fashion.

6 Claims, No Drawings

TWO PHASE EMULSION USEFUL IN EXPLOSIVE COMPOSITIONS

BACKGROUND OF THE INVENTION

1. Field of the Invention

The present invention relates to a novel oxidizer composition which is comprised of a two phase emulsion. The present invention also relates to explosive compositions prepared by use of the two phase emulsion oxidizer composition, which explosive compositions exhibit excellent bore hole stability, water resistance and flexibility with respect to heave and velocity.

2. Description of the Prior Art

Blasting agent compositions of the ammonium nitrate/fuel oil (ANFO) type have been and are widely used in commercial blasting operations. The explosive reaction involving ANFO, however, is extremely sensitive to water and its presence may hinder or prevent the blast. In fact, a major concern is to find an explosive composition with a long term storage ability, and with a good moisture resistance so as to prevent the decomposition of the oxidizing agent. Such compositions have been suggested for example in U.S. Pat. No. 5,397,405. This patent describes an explosive composition which comprises a waste oil, ammonium nitrate and lignite. The presence of the lignite provides a high concentration of carbon, sulfur and hydrogen, thus increasing the presence of gases such as methane, and thus increasing accordingly the blasting effect. The lignite is often used in the form of concentrated bituminous coal powder.

ANFO has also been used in combination with emulsion blends. An industrial grade prill oxidizer is generally used to prepare the ANFO/emulsion blends, with such blends being considered self-sensitizing. However, problems arise in that prills available and practicable for ANFO are of varying density and are chemically variable in the use of binders and coatings. This variability of prills in the chemistry preclude the bulk manufacture of an emulsion which is compatible with the prill over time. Thus, flexibility with regard to the use of an emulsion is limited.

Thus, the industry is desirous obtaining an explosive composition which can offer some flexibility in its preparation, as well as improved sleep time in a bore hole. Improved water resistance and flexibility with respect to heave and velocity would also be beneficial characteristics of a novel explosive composition.

Explosive compositions which comprise ammonium nitrate and an emulsion have been known. U.S. Pat. No. 5,397,399 discloses an emulsion explosive composition which includes an oxidizer salt, carbonaceous fuel and an emulsifier. The emulsion explosive composition is sensitized by gassing, which gassing procedure involves adding a quantity of the second emulsion to the emulsion explosive composition. The second emulsion includes an aqueous solution of hydrogen peroxide, a carbonaceous fuel and an emulsifier. Oxygen gas bubbles are produced throughout the explosive composition upon mixing by the degradation of the hydrogen peroxide, which degradation may be catalyzed by a metal salt catalyst. The mixing is easily achieved on site at the location of use of the explosive. The gassing is believed to provide more uniform gas bubble distribution within the emulsion explosive composition. Such compositions, however, do not solve many of the problems of improved sleep time, flexibility in manufacture with regard to the ammonium nitrate used, as well as improved flexibility in shot performance.

Mixing of two phases to form an emulsion explosive is described in published European Patent Application 0 228 354. Disclosed is a method for preparing a water-in-oil type emulsion explosive, which method comprises preparing a pre-emulsion from a fuel phase and a first part of an oxidizer phase, and an oxidizing composition from the second part of the oxidizer phase and a void containing or void generating material. The pre-emulsion and the oxidizing composition are then emulsified to form the final emulsion. The disclosed method, however, does not provide the flexibility the industry is desirous of obtaining.

Accordingly, it is an object of the present invention to provide a novel emulsion composition which is useful in the preparation of explosive compositions.

Yet another object of the present invention is to provide one with a water in oil emulsion which allows great flexibility with regard to the preparation of an explosive composition.

Still another object of the present invention is to provide an explosive composition which exhibits improved sleep time in a bore hole.

Yet another object of the present invention is to provide an explosive emulsion which can exhibit great flexibility in its shot performance with regard to velocity and heave.

These and other objects of the present invention will become apparent upon a review of the following specification and the claims appended thereto.

SUMMARY OF THE INVENTION

The foregoing objectives are achieved by providing a two phase emulsion, or an emulsion/emulsion, which is useful in preparing explosive compositions. In general, the two phase emulsion of the present invention is characterized as an oxidizer. The two phase emulsion is comprised of a blend of two emulsions. The first emulsion is a water in oil emulsion comprised of an aqueous ammonium nitrate solution as a discontinuous phase in a common continuous phase of a matrix oil, plus an emulsifier. The second emulsion is also a water in oil emulsion which is comprised of an aqueous phase in an oil matrix with an emulsifier or surfactant. The two emulsions are blended in a manner such that a water in oil emulsion is created which has a continuous oil matrix in which ammonium nitrate micelles and water micelles both exist. It is this blended, stable two phase emulsion which provides the many advantages of the present invention.

The two phase emulsion can be used in preparing an explosive composition by mixing the emulsion with an oxidizer such as ammonium nitrate. ANFO need not be used, but may be used. Pre-oiling of the ammonium nitrate mixed with the emulsion is not necessary.

Besides the improved flexibility of using the emulsion with ammonium nitrate to prepare an explosive composition, the prepared explosive compositions also exhibit excellent "sleep time" while resting in a bore hole before being shot. The two phase emulsion of the present invention also provides advantages in flexibility with regard to the particular composition that may be used to prepare an explosive composition, as well as flexibility in the shot performance of the explosive composition.

DETAILED DESCRIPTION OF THE PREFERRED EMBODIMENTS

The two phase emulsion of the present invention is prepared by blending two different water in oil emulsions. The first emulsion is a traditional water in oil type ammonium nitrate emulsion. Preferably, the ammonium nitrate comprises about 65–90 wt % and preferably 75–80%, of the emulsion and is added as an aqueous solution. A mixture of amminium nitrate with a minor amount of another salt, such as calcium nitrate, can be used if desired, but it is preferred to use ammonium nitrate alone. The remainder of the emulsion is comprised of the continuous oil phase and an emulsifier. It is the ammonium nitrate which is the oxidizer portion of the two phase emulsion.

The second emulsion is also a water in oil emulsion. The continuous oil phase can be any oil which is compatible with the oil phase of the first emulsion. The continuous oil phase can be comprised of recycled oils or any of the other oils generally suitable for explosive emulsions. Such oils include mineral oils or number two fuel oil. It is preferred that the continuous oil phase in the second emulsion be the same oil as used in the continuous phase of the first emulsion.

The non-continuous phase in the second water in oil emulsion is comprised of water. The water phase can include additional components dissolved in the water, which possibility allows for tailoring the explosive in many different ways. In addition, sensitizer diluents, combusting catalysts, and/or oxidizer enhancers can be dissolved/dispersed in the water phase of the second emulsion. In a preferred embodiment, however, the discontinuous phase of the second emulsion comprises only water. For example, the second emulsion can be comprised of about 50% wt oil and about 50% wt water.

An emulsifier is also necessary for the second emulsion. If recycled oil is used as the continuous oil phase, the recycled oils can contain intrinsic surfactants which can perform the function of the emulsifier. Among the useful emulsifiers are sorbitan monooleate, isopropyl esters of lanolin fatty acids and numerous other materials. A discussion of emulsifying agents of the type usable in the present invention is contained in U.S. Pat. No. 4,708,753 to Forsberg, which is incorporated herein by reference. A most preferred emulsifying agent is based upon adducts of polyisobutylene succinic anhydride (PIBSA). Such emulsifying agents are commercially available, and are most preferred for use in explosive compositions. In general, it is preferred that the emulsifier is also the same as that of the emulsifier used in the first emulsion.

Once the two emulsions are prepared, the two emulsions are blended. The blending process is a gentle process without any significant shear energy being used to blend the two emulsions. For example, mixing can be accomplished using a concrete type mixer, a low rpm paddle mixer or convergent streams mixing. The resulting blended emulsion is a two phase water in oil emulsion in the sense that there is a single continuous phase comprised of the oil, but there are two discontinuous phases. The one discontinuous phase is the ammonium nitrate phase from the first emulsion, and the second discontinuous phase is the water phase from the second emulsion. The two phases remain stable in the blended emulsion. If too much energy is used in blending the emulsion, migration of the micelles together would happen such that a single discontinuous phase may be created. However, with the blending of the present invention the different micelles remain intact. The surfactant/emulsifier is believed to coat the micelles and keep the micelles apart from one another to prevent migration. No joining of the micelles occurs, and thus the two phase water in oil emulsion is created.

The created emulsion is stable, and as noted above allows for flexibility in the tailoring of an explosive composition. The tailoring can be achieved through changing the second emulsion in terms of the amount of water included therein, as well as components dissolved in the water.

Once the two phase emulsion has been prepared, an explosive composition can be prepared by blending the emulsion with ammonium nitrate. The variability of industrial grade ammonium nitrate that exists in the industry is of no consequence in the practice of the present invention.

When using ammonium nitrate in prill form, an ANFO is not necessary. The prill need not be pre-oiled, but can be free of oil. A large advantage of using the two phase emulsion/prill blend as an explosive composition is that the blend will not dry out and thus will have a longer bore hole shelf life. Thus, the two phase emulsion/prill blends of the present invention exhibit excellent stability in the bore hole, i.e., "sleep time" while resting in the bore hole. Such stability allows a mixing of the emulsion and prill at a mine site and allowing it to sit in a hole for up to several months before being shot.

In general, the explosive composition comprises 47% of the prill by weight, 47% by weight of the first emulsion, and 6% by weight of the second emulsion. The second emulsion is generally comprised of only water and oil, and emulsifier. Such an explosive composition is booster sensitive, i.e., it is a blasting agent.

In general, therefore, the explosive compositions of the present invention permit flexibility in many different applications. Since the two phase emulsion is compatible with many different industrial grade prills great flexibility is possible in the preparation of an explosive composition. Furthermore, the bore hole stability exhibited is extremely good. This translates into flexible sleep time in the bore hole, where the explosive composition can sometimes sit from two to three months before it is shot.

The presence of the water actually leads to great flexibility with regard to the shot performance of the explosive composition. While traditional ANFO/emulsion explosive compositions provide 15 to 17,000 ft./sec. in velocity, the explosive composition of the present invention generally provides from 11 to 12,000 ft./sec. It is believed that as gas builds up with the extra water present, one achieves higher heave and lower velocity. Some open pit mining operations can require shots with a large heave and lower velocity. Also, some open pit operations require long sleep time in bore holes, where the explosive is generally loaded for up to 8 to 12 weeks before shooting. Thus, the compositions of the present invention provide an excellent explosive composition for such mining purposes.

It should also be noted that by adding voids or bubbles to the explosive composition, one can raise the velocity to higher limits. The more voids or bubbles added to the ultimate composition, the higher the velocity. An explosive composition can also be created by simply adding the voids or bubbles to the two phase emulsion of the present invention. The use of a prill is not necessary, although, generally preferred. Furthermore, by changing the water content, i.e., increasing the water content, the velocity can be slowed, e.g., as low as 5,000 ft./sec. or lower. Thus, great flexibility can be achieved in tailoring the shot performance to the particular mining operation involved. The emulsifier used in all of the following examples is a PIBSA adduct.

The invention will be illustrated in greater detail by the following specific examples. It is understood that these examples are given by way of illustration and are not meant to limit the disclosure of the claims to follow. All percentages in the examples, and elsewhere in the specification, are by weight unless otherwise specified. The emulsifier used in all of the following examples is a PIBSA adduct.

EXAMPLE 1

A 6 inch PVC (polyvinyl chloride) pipe was loaded with an explosive composition comprised of 47% by weight of an explosive grade ammonium nitrate prill, and the remainder comprising a two phase emulsion in accordance with the present invention. The two phase emulsion was prepared by making a first emulsion comprised of about 76.36 wt % ammonium nitrate, 15.64% water, 6.56% mineral oil and 1.44% by weight of an emulsifier, and combining with a second emulsion made of 50.0% water, and 50.0% column distilled recycle industrial oil with intrinsic emulsifiers. The two emulsions were combined in amounts such that when added to the ammonium nitrate prill, the final explosive composition contained 47% by weight of the ammonium nitrate prill, 47% by weight of the first emulsion and 6% by weight of the second emulsion. The PVC pipe was then capped and sealed, and pressurized to 110 psi. The pipe was then detonated using a ¾# primer. The shot was approximately 5 kilograms and detonated in full order. Visual observation showed no pipe or material left.

EXAMPLE 2

The explosive composition of Example 1 was loaded into a 6⅞ inch diameter borehole, allowed to sleep (sit) for five weeks, and then detonated with a ¾# primer. The detonation went well, and the detonation velocity was measured at 11,256 ft./sec.

EXAMPLE 3

The explosive composition of Example 1 was loaded into a 6⅞ inch diameter borehole and allowed to sit for seven weeks. The explosive was then detonated using a ¾# primer. Detonation velocity was measured to be 10,665 ft./sec.

EXAMPLE 4

The explosive composition of Example 1 was loaded into a 6⅞ inch diameter borehole and allowed to sit for nine weeks. The explosive was then detonated using a ¾# primer. Detonation velocity was not measured but visual observation showed breakage around the borehole equal to what was seen in Examples 2 and 3 after detonation.

EXAMPLE 5

A first emulsion was made using 69% by weight ammonium nitrate, 14% by weight water, 9% by weight ammonium chloride, 6.57% by weight mineral oil and 1.43% by weight emulsifier. A second emulsion was made using 51% by weight sodium nitrate, 41% by weight water, 6.57% by weight mineral oil and 1.43% by weight emulsifier. The two emulsions were combined to provide a two phase emulsion comprised of 21.6% by weight of the first emulsion and 78.4% by weight of the second emulsion. The final emulsion was then detonated and shot at a velocity of 19,926 ft./sec. This example demonstrates that the second emulsion can be altered to tailor the final explosive composition, either by changing the amount of water or adding a component to the water in the second emulsion.

EXAMPLE 6

A first emulsion was made comprised of 78.72% by weight ammonium nitrate, 16.12% by weight water, 4.236% by weight mineral oil and 0.824% by weight emulsifier. A second emulsion was made comprised of 82.71% by weight water, 14.19% by weight mineral oil and 3.10% by weight emulsifier. The two emulsions were combined at a ratio of 84.82% by weight of the first emulsion and 15.18% by weight of the second emulsion. The resulting two phase emulsion was then sensitized with 2% by weight glass microspheres about 65–75 microns in diameter (K-1 glass microspheres available from 3M Co.). The sensitized emulsion shot at a velocity of 18,000 ft./sec.

COMPARATIVE EXAMPLE 1

A 50/50 emulsion/ANFO blend was made using an emulsion comprised of 76.36% by weight ammonium nitrate, 15.64% by weight water, 6.56% by weight mineral oil and 1.44% by weight emulsifier blended in a 1:1 ratio with an ANFO which comprised 94% by weight industrial grade prill and 6% by weight fuel oil. The first day the blend was loaded it shot at a velocity of 16,038 ft./sec. After three weeks of sitting in a borehole, the blend no longer detonated.

While the invention has been described with preferred embodiments thereof, it is to be understood that variations and modifications may be resorted to as will be apparent to those skilled in the art. Such variations and modifications are to be considered within the purview and the scope of the claims appended hereto.

We claim:

1. An emulsion comprised of a continuous phase comprised of an oil, a first discontinuous phase comprised of an aqueous ammonium nitrate solution, and a second discontinuous phase, different from the first discontinuous phase, comprised of water, with the emulsion being stable and both discontinuous phases remaining separate.

2. A process for preparing the emulsion of claim 1, with the process comprising preparing a first water in oil emulsion comprised of a discontinuous phase of an aqueous ammonium nitrate solution, a continuous phase of oil, and an emulsifier, preparing a second water in oil emulsion comprised of a discontinuous phase comprised of water, a continuous phase comprised of oil, and an emulsifier, and blending the two water in oil emulsions so that a water in oil emulsion is created comprised of two distinct discontinuous phases, one comprising the aqueous ammonium nitrate solution from the first emulsion and the other comprising the water discontinuous phase from the second water in oil emulsion.

3. An explosive composition comprised of the emulsion of claim 1 blended with ammonium nitrate.

4. The explosive composition of claim 3, wherein the ammonium nitrate blended with the emulsion comprises about 47% by weight of the composition, the first water in oil emulsion contributes about 47% by weight to the composition, and the second water in oil emulsion contributes about 6% by weight to the composition.

5. An explosive composition comprised of the emulsion of claim 1 combined with a void material.

6. The explosive composition of claim 5, wherein the void material is comprised of glass bubbles.

* * * * *